US005941745A

United States Patent [19]

Kanno

[11] Patent Number: 5,941,745

[45] Date of Patent: Aug. 24, 1999

[54] FUEL AND LUBRICANT SYSTEM FOR MARINE ENGINE

[75] Inventor: Isao Kanno, Hamamatsu, Japan

[73] Assignee: Sanshin Kogyo Kabushiki Kaisha, Hamamatsu, Japan

[21] Appl. No.: 08/925,235

[22] Filed: Sep. 8, 1997

[30] Foreign Application Priority Data

Sep. 6, 1996 [JP] Japan ..... 8-236407

[51] Int. Cl.[6] ..... B63H 21/38

[52] U.S. Cl. ..... 440/88; 123/73 AD

[58] Field of Search ..... 440/88; 123/196 R, 123/73 AD, 196 W; B23H 21/38

[56] References Cited

U.S. PATENT DOCUMENTS

| | | | |
|---|---|---|---|
| 4,142,486 | 3/1979 | Schreier | 123/73 |
| 4,403,578 | 9/1983 | Iwai et al. | 123/73 |
| 4,480,602 | 11/1984 | Kobayashi et al. | 123/73 |
| 4,539,949 | 9/1985 | Walsworth | 123/73 |
| 4,594,970 | 6/1986 | Baars et al. | 123/73 |
| 5,235,944 | 8/1993 | Adachi . | |
| 5,287,833 | 2/1994 | Yashiro . | |
| 5,297,511 | 3/1994 | Suzuki . | |
| 5,355,851 | 10/1994 | Kamiya . | |
| 5,390,635 | 2/1995 | Kidera et al. . | |
| 5,511,524 | 4/1996 | Kidera et al. . | |
| 5,630,383 | 5/1997 | Kidera et al. . | |

*Primary Examiner*—Sherman Basinger
*Assistant Examiner*—Patrich Muldoon
*Attorney, Agent, or Firm*—Knobbe, Martens, Olson & Bear LLP

[57] ABSTRACT

A fuel and lubricant supply system for an engine of the type utilized to power an outboard motor of a watercraft is disclosed. The system includes a fuel supply and a delivery mechanism for delivering fuel from the supply through a fuel system including at least one charge former. The system also includes a lubricant supply and a delivery mechanism for delivering lubricant from the supply through a lubricant system to at least a portion of the fuel system. A fluid pressure operated check valve is provided along the lubricant system for preventing the flow of fuel into the lubricant system. Preferably, the check valve includes a fluid sensor providing data to a control unit which controls the lubricant delivery mechanism for controlling the volume of lubricant delivered to the fuel system.

16 Claims, 14 Drawing Sheets

122
74
126
120
118
116
124
116
Air
Oil

FUEL AND LUBRICANT SYSTEM FOR MARINE ENGINE

FIELD OF THE INVENTION

The present invention relates to a lubricant and fuel supply system for an internal combustion engine of the type utilized to power an outboard motor.

BACKGROUND OF THE INVENTION

Internal combustion engines are often used to power inboard or outboard motors for propelling watercraft. These engines are operated in environments which expose them to conditions favoring corrosion. For example, the watercraft may be operated in a body of salt water, with the engine exposed to both the liquid water and salt air.

Corrosion may damage a variety of sensitive parts of the engine, such as the fuel injectors, high pressure fuel rail and related componentry. As such, it has been found desirable to deliver lubricant to these components to minimize the corrosive effects.

Several problems are encountered in providing lubricant to the functions. Preferably, an oil level sensor 78 is provided corresponding to the main lubricant tank 58. This sensor 78 provides data to the ECU 76 regarding the level of lubricant in the tank 58. A similar sensor 80 is preferably provided corresponding to the secondary lubricant tank 62.

As is well known in the art of engine control, the ECU 76 utilizes the sensor data to optimize engine operating parameters. For example, the ECU 76 utilizes the data to change the ignition coil(s) and selectively fire the ignition element corresponding to each cylinder lubricant or "oil" supply system provides oil into the fuel being supplied to the engine for mixing therewith, so that a mixture of oil and fuel is supplied to each charge former.

In accordance with the present invention, a fluid pressure activated check valve is positioned along the lubricant supply system before a point of introduction of the lubricant into the fuel, whereby fuel is prevented from flowing into the lubricant supply system. Preferably, the check valve includes fluid sensor means for sensing the fluid and providing data to a control unit. The sensor means may comprise a fluid pressure or flow rate sensor. The control unit is arranged to utilize data from the sensor to control the delivery of lubricant into the fuel system.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In general, the present invention is a fuel and lubricant delivery system for an internal combustion engine of the type utilized to power an outboard motor. The system is of the type in which lubricant is supplied into the fuel system, whereby a combination of fuel and lubricant is supplied to at least a portion of the fuel system. As used herein, it is understood that the terms "oil" and "lubricant" are generally interchangeable, and may mean the natural petroleum mineral, a man-made synthetic material, or mixture thereof.

Figure 1:
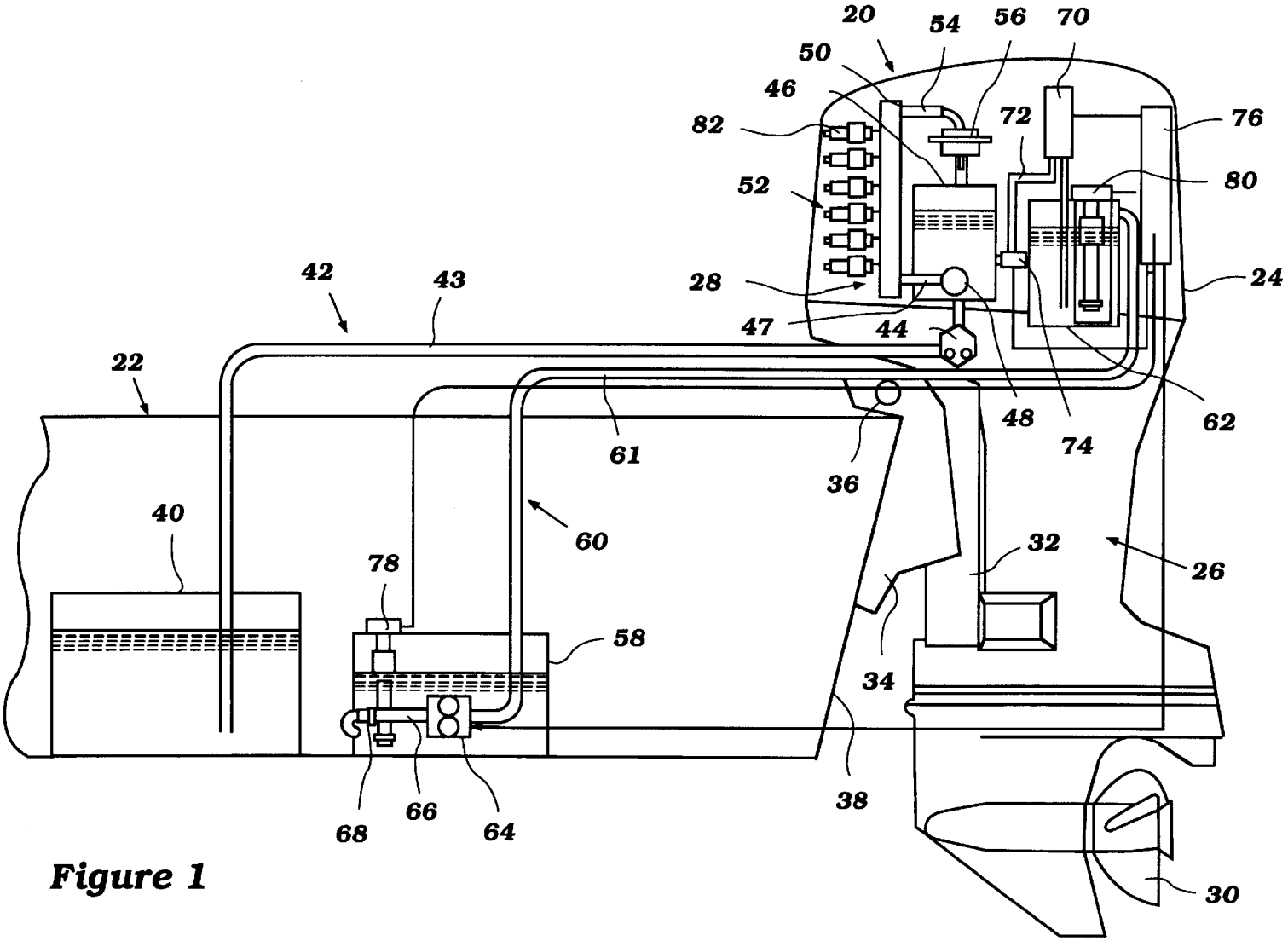
FIG. 1 is a side view of an outboard motor connected to a watercraft, the motor and watercraft illustrated in partial cross-section exposing an oil and fuel delivery system for an engine thereof in accordance with a first embodiment of the present invention.

Referring to FIG. 1, an outboard motor 20 is utilized to propel a watercraft 22. The motor 20 may be of any number of varieties. As illustrated, the motor 20 has a body generally defined by a cowling portion 24 and a lower unit 26 depending therebelow. An engine 28 is positioned within the cowling portion 24. The engine 28 is arranged in driving relation with a water propulsion device of the motor 20, whereby the motor 20 propels the watercraft 22. In the embodiment illustrated, the water propulsion device is a propeller 30.

The outboard motor 20 is arranged to move left or right with respect to the watercraft 22 for steering the watercraft. The lower unit 26 is connected to a steering shaft (now shown) which is rotatably positioned about a vertical axis within a steering bracket 32. In turn, the steering bracket 32 is rotatably connected to a clamping bracket 34 about a generally horizontally extending pin 36. The clamping bracket 34 is connected to a transom portion of a hull 38 of the watercraft 22.

The engine 28 is of the internal combustion variety. The particular arrangement of the engine 28 may vary as known to those skilled in the art. By way of example only, the engine 28 may be of the rotary variety, or be of the piston and cylinder variety. If of the piston including type, the engine 28 may have as few as one cylinder, or many more than one. Further, the engine 28 may operate on a four-cycle or two-cycle principal. In the embodiment illustrated, the engine 28 has six cylinders arranged in in-line fashion.

Regardless of the specific engine orientation and operating principal, the engine 28 includes a fuel supply or delivery system for delivering fuel to each combustion chamber thereof, and a lubricant supply or delivery system for delivering lubricant to one or more components and areas of the engine.

Generally, the fuel system includes a fuel supply or source. In the preferred embodiment, the supply comprises a fuel tank 40 positioned within the hull 38 of the watercraft 22. Means are provided for delivering fuel from the tank 40 through a fuel system. Preferably, the fuel system includes a fuel supply pipe 42 defining an internal conduit 43 extending from the tank 40 to a low pressure fuel pump 44 positioned within the cowling portion 24 of the motor 20 near the engine 28. The low pressure fuel pump 44 is preferably of the diaphragm, pressure activated type. In this arrangement, the means for delivering the fuel from the tank 40 comprises the low pressure fuel pump 44. As known to those skilled in the art, other delivering mechanisms may be utilized, such as roller pumps, gravity-feed and the like.

An output of the low pressure fuel pump 44 leads to the remainder of the fuel system, including a vapor separator 46. The vapor separator 46 may be of a number of types known to those skilled in the art, and is arranged to separate air from the fuel.

A high pressure pump 48, preferably positioned within the vapor separator 46, draws fuel from the separator 46 and delivers it under high pressure through a high pressure delivery line 47 to a fuel rail 50. A fuel injector 52 corresponding to each cylinder of the engine 28 is utilized to delivery fuel from the fuel rail 50 into the combustion chamber portion of each cylinder for combustion. The high pressure pump 48 is preferably of the electric variety.

Fuel which is not delivered through the fuel rail 50 to the fuel injectors 52 is returned to the vapor separator 46 through a return line 54. A pressure valve 56 is positioned along the return line 54 for maintaining the fuel in the fuel rail 50 under high pressure, and yet allowing fuel to return to the separator 46.

Of course, the fuel system may include additional features, and may include other types of charge formers than injectors 52. Also, the injectors 52 may be arranged to directly or indirectly inject the fuel, as known in the art.

A lubricant or oil supply system is also provided for the engine 28. In the embodiment illustrated, the lubricant system provides oil into the fuel system for delivery with the fuel as an oil and fuel mixture to each injector 52.

The lubricant supply system includes a lubricant supply or source. Preferably, the source comprises a tank 58 positioned within the hull 38 of the watercraft 22. Means are provided for delivering oil from the tank 58 to the fuel system through a lubricant supply system including an oil supply pipe 60. The oil supply pipe 60 defines a supply conduit 61 leading from the tank 58 to a secondary or sub-oil tank 62 positioned within the cowling 24 of the motor 20. Preferably, the means for delivering the oil comprises an oil pump 64 positioned within the oil tank 58. The oil pump 64 draws oil through an intake pipe 66 and an oil filter 68 positioned therealong and delivers it to the tank 62 in the motor 20. As illustrated, the oil pump 64 is of the mechanical roller type.

The means for delivering preferably also includes a second oil pump 70. This pump 70 is preferably positioned within the cowling 24 of the motor 20, and draws oil from the secondary tank 62 and delivers it through a delivery line 72 to the vapor separator 46 for mixing with the fuel therein. As illustrated, a check valve 74 is positioned along the delivery line 72 for preventing the reverse flow of fuel and lubricant from the vapor separator 46 in the direction of the oil tank 62.

The exact operation of the valve 74 is described below in conjunction with FIGS. 9–14. As discussed there in detail, the valve 74 is preferably of the type which allows fluid to flow therethrough upon application of sufficient application of fluid pressure on the delivery side (i.e. the side leading from pump 70 in this case), and which closes when insufficient delivery pressure is applied, preventing the reverse flow of fluid therethrough. In addition, the check valve 74 preferably includes a flow sensor, such as a pressure sensor, for providing a signal to the ECU 76 for use in determining the flow rate of lubricant through the valve 74. In this manner, the actual amount of lubricant being supplied to the fuel may accurately be determined, and thus the ECU 76 may accurately control the pump 70 as necessary to affect lubricant flow to the fuel system The lubricant delivered to the vapor separator 46 mixes with the fuel, with the resulting mixture being drawn by the high pressure pump 48 for delivery to the fuel injectors 52.

Many of the other features of the engine 28 are well known to those skilled in the art, and thus not described in detail here. The engine 28 of the type illustrated generally has a crankshaft which is driven by a piston movably mounted in each cylinder. The crankshaft is arranged to drive the propeller 30 of the motor 20. The engine 28 includes an air supply system for supplying air to each combustion chamber for combustion of the fuel. A suitable throttle is provided for controlling the flow of air to the cylinders. A suitable ignition system is provided for igniting the air and fuel mixture in each combustion chamber. This ignition system may include a coil for providing an ignition spark in each combustion chamber via a spark plug corresponding to each combustion chamber.

A control unit such as an ECU 76 is provided for monitoring various of the operating conditions of the engine 28, and for controlling various of the engine functions. Preferably, an oil level sensor 78 is provided corresponding to the main lubricant tank 58. This sensor 78 provides data the ECU 76 regarding the level of lubricant in the tank 58. A similar sensor 80 is preferably provided corresponding to the secondary lubricant tank 62.

As is well known in the art of engine control, the ECU 76 utilizes the sensor data to optimize engine operating parameters. For example, the ECU 76 utilizes the data to change the ignition coil(s) and selectively fire the ignition element corresponding to each cylinder at the correct time. The ECU 76 also activates each fuel injector 52 (such as by providing an electric signal to a solenoid 82 of each fuel injector 52) at the correct time for injecting fuel into each combustion chamber. In addition, the ECU 76 sends electric signals to the electric high pressure pump 48 and oil pumps 64,70 for providing oil and fuel to the engine 28.

In accordance with the present invention, the fuel and lubricant supply system described provides lubricant to the fuel system, including the fuel injectors 82. The supplied lubricant is useful in preventing corrosion of the fuel injectors 82 and the like. Advantageously, the check valve 74 prevents the flow of the fuel and lubricant mixture from the vapor separator 46 back into the sub-oil tank 62 positioned within the cowling 24. This prevents fouling of the lubricant in the lubricant system.

In addition, the check valve 74 provides accurate data to the ECU 76 regarding the flow of lubricant to the fuel system. Then, the ECU 76 may accurately control the means for delivering the lubricant to the fuel system (i.e. pump 70) to control the lubricant flow to the fuel system in the desired amounts.

Another advantage of the system illustrated in FIG. 1 is that little fuel and lubricant supply system componentry need be positioned in the hull 38 of the watercraft 22, thus leaving more space for the user.

Figure 2:
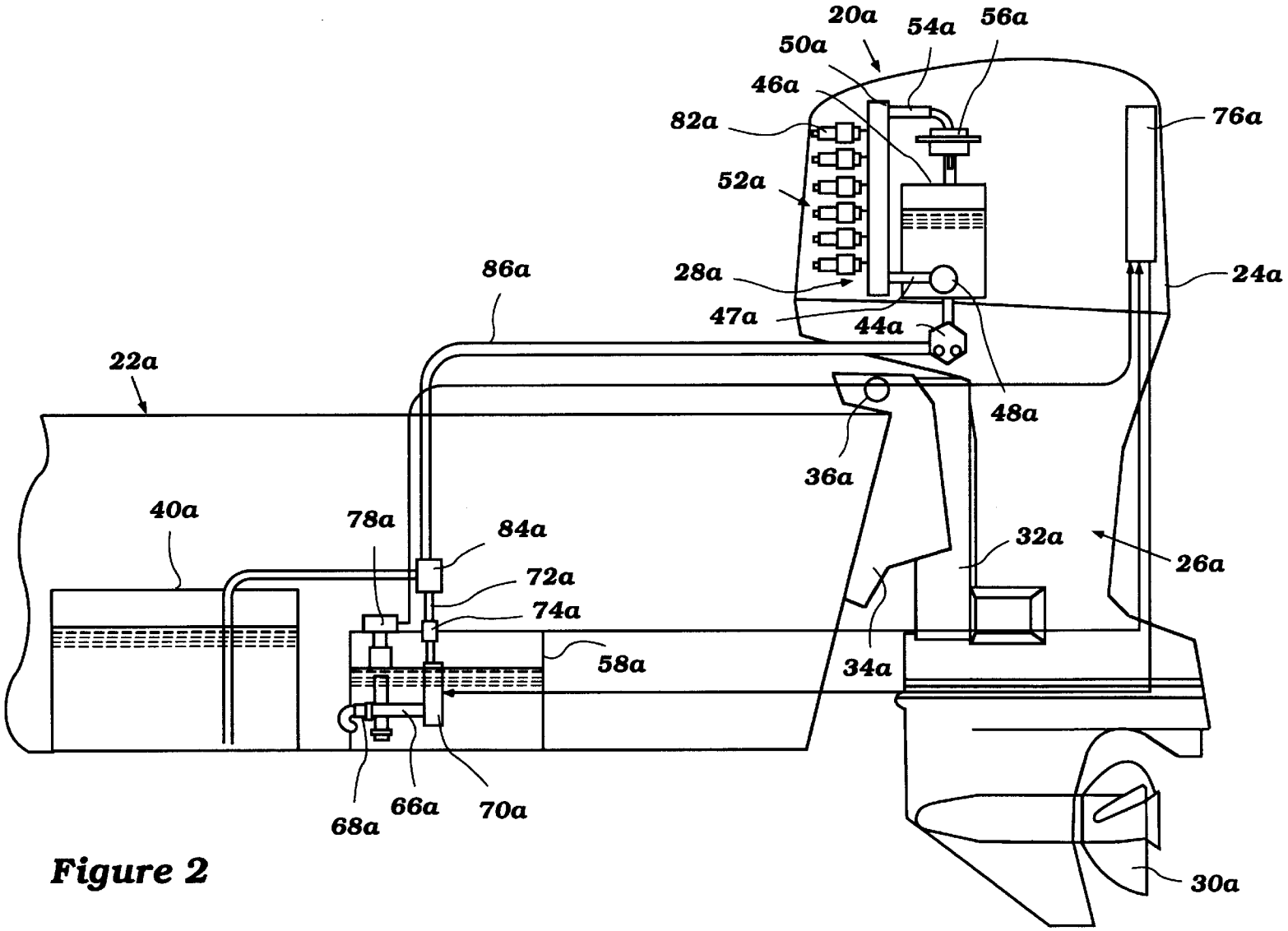
FIG. 2 is a side view of an outboard motor connected to a watercraft, the motor and watercraft illustrated in partial cross-section exposing an oil and fuel delivery system for an engine thereof in accordance with a second embodiment of the present invention.

A fuel and lubricant supply system in accordance with a second embodiment of the present invention is illustrated in FIG. 2. In the description and illustration of this embodiment, like parts have been given like reference numerals to those utilized to describe and illustrate the first embodiment, except that an "a" designator has been added thereto.

In this embodiment, the main lubricant pump 70*a* is positioned at the primary lubricant tank 58*a,* and the secondary tank (62) and pump (64) of the first embodiment are eliminated. In this embodiment, the lubricant pump 70*a* pumps lubricant from the tank 58*a* through a valve 74*a* positioned along a delivery line 72*a*. The line 72*a* joins with a main fuel supply line 42*a* at a mixer 84*a*. A single fuel and lubricant delivery line 86*a* leads from the mixer 84*a* to the a pump 44*a,* the pump 44*a* pumping the fuel and lubricant mixture and delivering it into a vapor separator 46*a*. A high pressure pump 48*a* delivers the mixture from the separator 46*a* to the fuel injectors 52*a* in a manner similar to that described above.

In this embodiment, the single pump 70*a* and single oil tank 58*a* are advantageously positioned in the watercraft 20*a*. This arrangement reduces the amount of space within the cowling 24*a* which is occupied by the oil and fuel delivery system, allowing the powerhead to be smaller and/or other engine arrangements to be utilized. The system includes a check valve 74*a* having the same advantages as those described in conjunction with the first system.

Another advantage of this system is that the pump 70*a* is provided near the oil tank 58*a*. As may be understood, in this arrangement, the pump 70*a* is not required to draw the lubricant a large distance from the tank 58*a*. As may be appreciated, if the pump 70*a* is required to draw lubricant over a long distance or vertically upward, a large suction force is necessary. This requires the pump to be very large and powerful, and may also have the effect of damaging the suction line unless of similar capacity (i.e. thinner pipe or hose may be damage upon application of such a suction force). In the present arrangement, the pump 70*a* needs little drawing force to draw the lubricant, and then can deliver the lubricant under high pressure.

Figure 3:
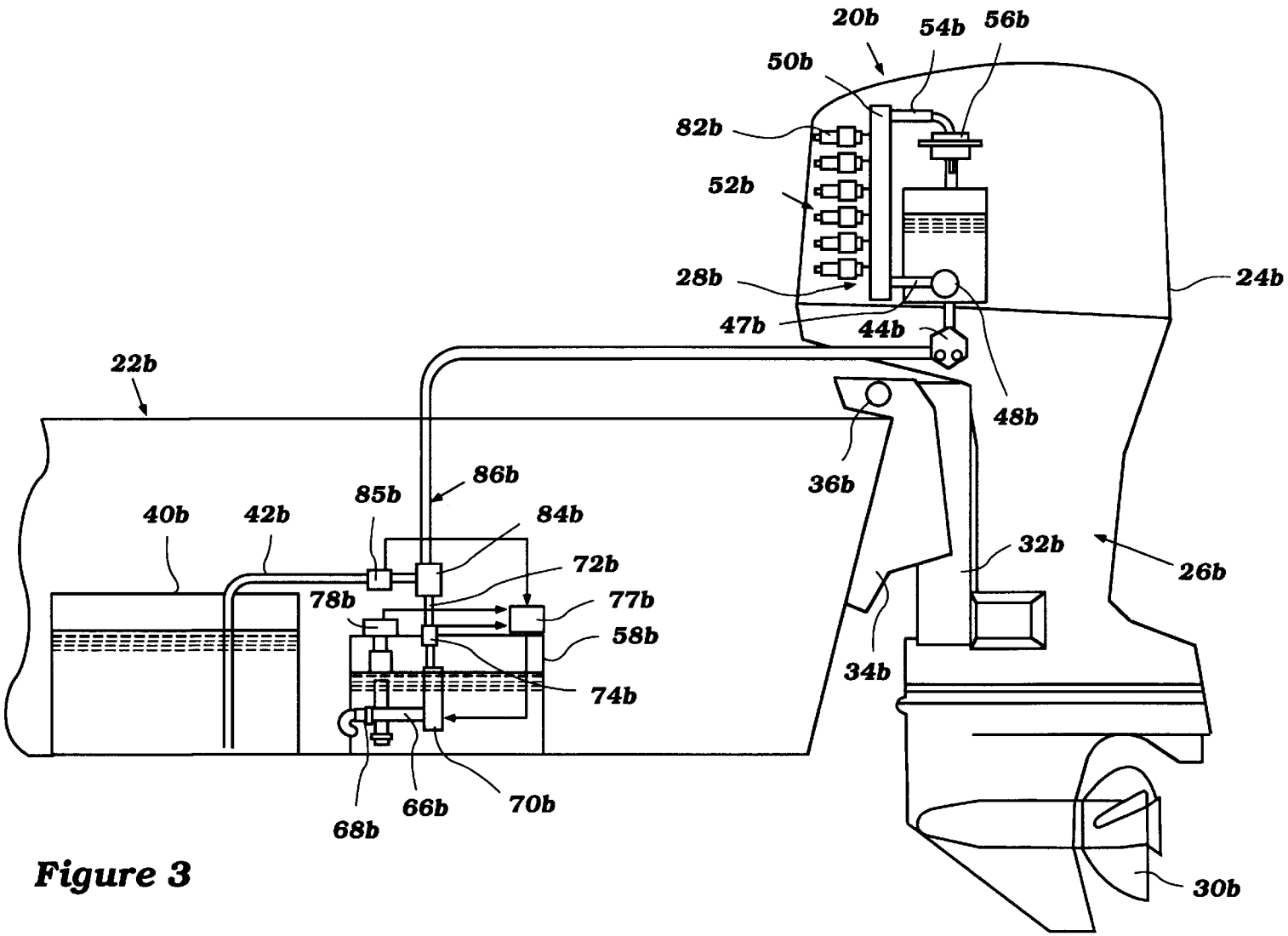
FIG. 3 is a side view of an outboard motor connected to a watercraft, the motor and watercraft illustrated in partial cross-section exposing an oil and fuel delivery system for an engine thereof in accordance with a third embodiment of the present invention.

A fuel and lubricant supply system in accordance with a third embodiment of the present invention is illustrated in FIG. 3. In the description and illustration of this embodiment, like parts have been given like reference numerals to those utilized to describe and illustrate the above embodiments, except that a "b" designator has been added thereto.

This embodiment system is similar to that illustrated in FIG. 2 and described above. In this embodiment, however, a simple control unit 77*b* controls the lubricant pump 70*b,* obtaining rate of fuel flow data from a sensor 85*b* positioned along the fuel delivery line 42*b*. Preferably, the control unit 77*b* is positioned near the lubricant tank 58*b* or otherwise away from the motor 20*b* to save space within the cowling 25*b* thereof.

Figure 4:
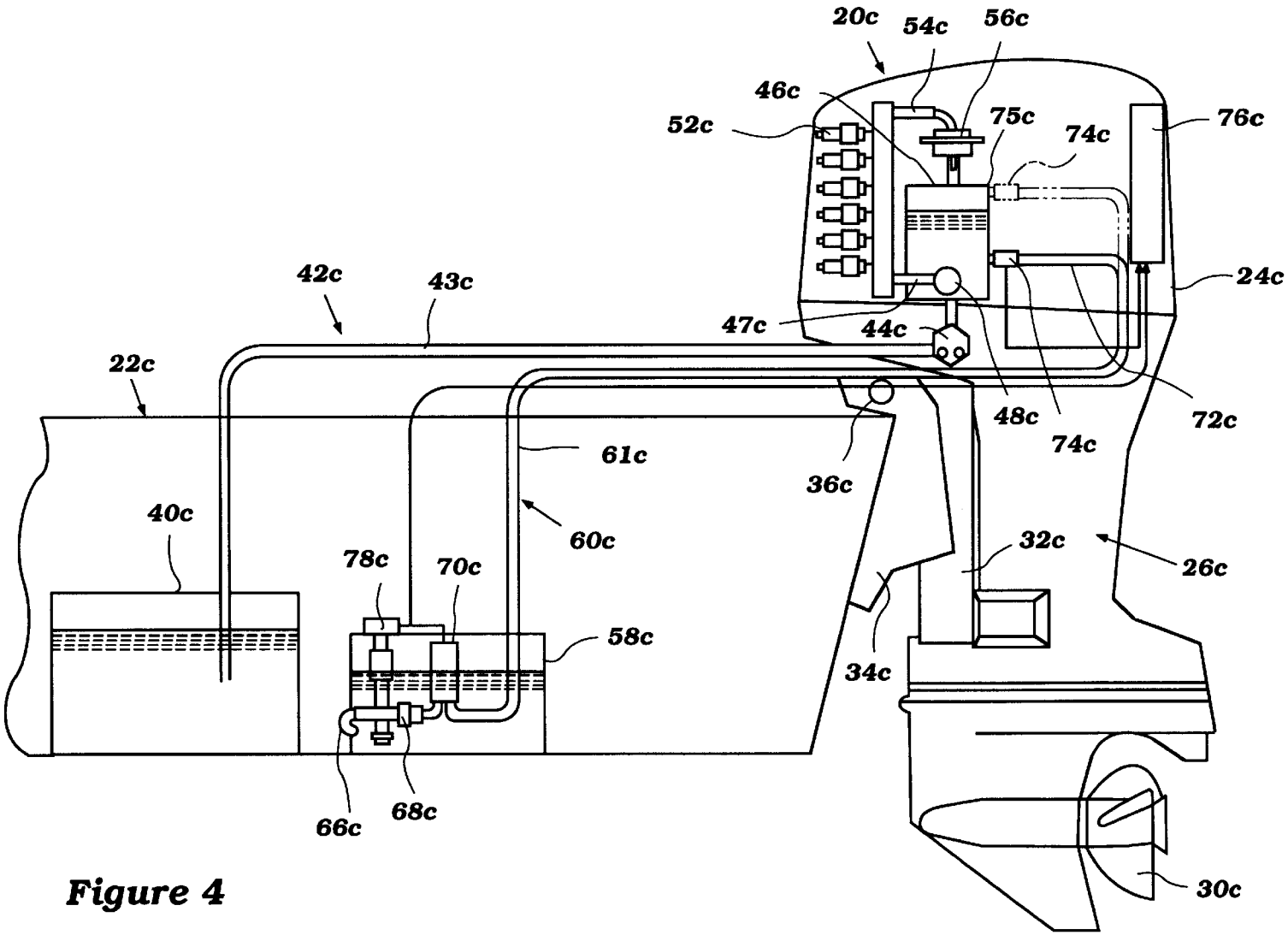
FIG. 4 is a side view of an outboard motor connected to a watercraft, the motor and watercraft illustrated in partial cross-section exposing an oil and fuel delivery system for an engine thereof in accordance with a fourth embodiment of the present invention.

A fuel and lubricant supply system in accordance with a fourth embodiment of the present invention is illustrated in FIG. 4. In the description and illustration of this embodiment, like parts have been given like reference numerals to those utilized to describe and illustrate the above embodiments, except that a "c" designator has been added thereto.

This embodiment system is somewhat similar to that illustrated in FIGS. 1–3 and described above. In this embodiment, however, a single lubricant pump 70*c* positioned at the lubricant tank 58*c* within the watercraft 22*c* delivers lubricant from the tank. As illustrated, the lubricant is delivered from the tank 58*c* through a supply line 61*c* directly to a vapor separator 46*c* for mixing with fuel therein.

The fuel is preferably delivered from the tank 40*c* within the watercraft 22*c* by a pump 44*c* positioned within the cowling 24*c* to the vapor separator 46*c*.

As illustrated, a lubricant inlet 75*c* to the vapor separator 46*c* may be positioned near the bottom thereof, whereby the lubricant flows directly into the fuel therein for mixing. Alternately, as illustrated in phantom lines in FIG. 4, the inlet 75*c*' may be positioned near a top of the separator 46*c* and above the fluid level therein, whereby the lubricant dumps into the fuel in the separator 46*c* for mixing therewith.

The embodiment system has the advantage that little of the fuel and lubricant supply system is provided in the cowling 24*c,* leaving a greater amount of space therein for other components, or otherwise allowing the cowling 24*c* to be smaller. Additionally, the use of the check valve 74*c* has the advantages stated above in conjunction with the prior embodiments.

Figure 5:
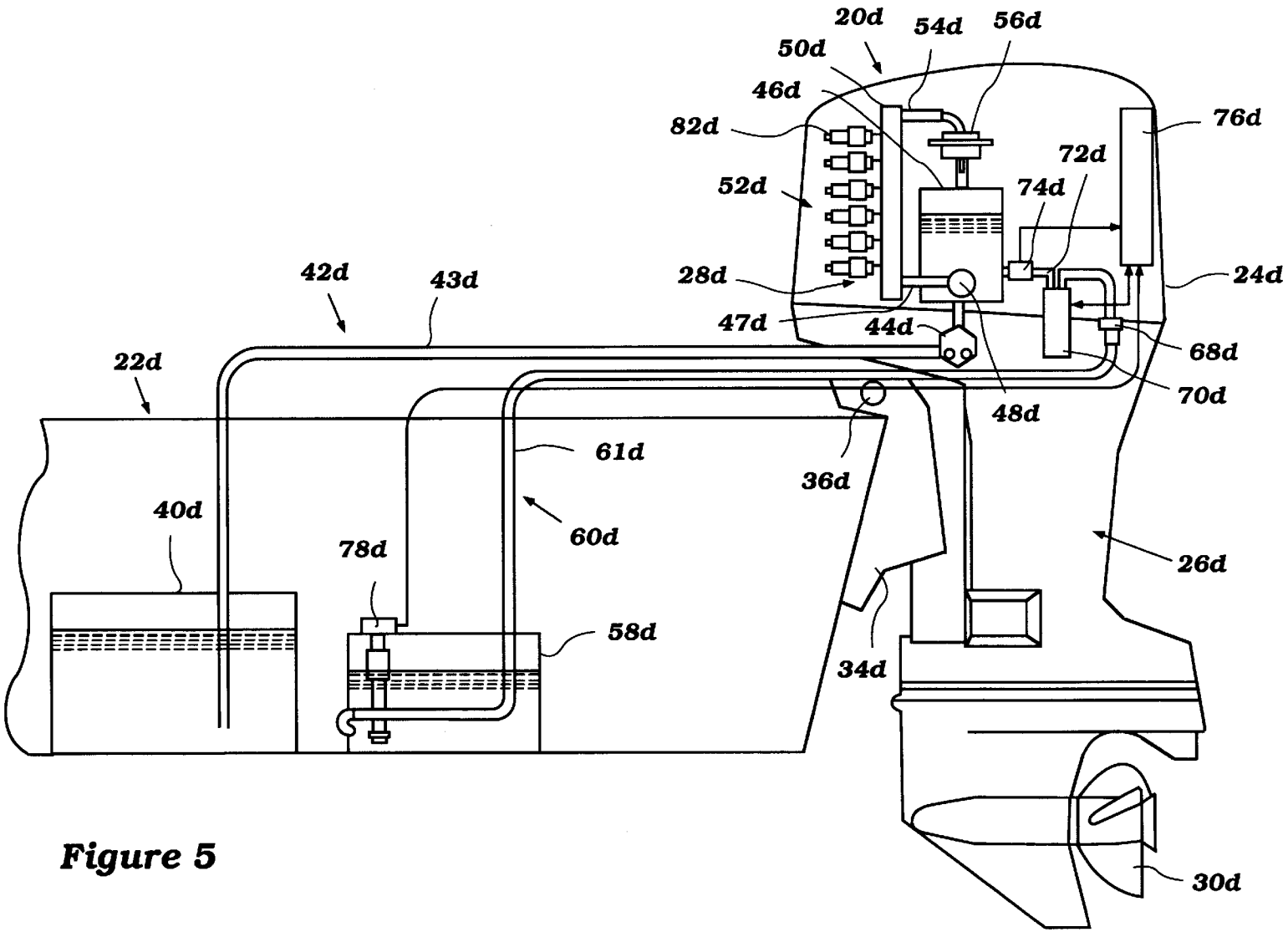
FIG. 5 is a side view of an outboard motor connected to a watercraft, the motor and watercraft illustrated in partial cross-section exposing an oil and fuel delivery system for an engine thereof in accordance with a fifth embodiment of the present invention.

A fuel and lubricant supply system in accordance with a fifth embodiment of the present invention is illustrated in FIG. 5. In the description and illustration of this embodiment, like parts have been given like reference numerals to those utilized to describe and illustrate the above embodiments, except that a "d" designator has been added thereto.

This embodiment system is similar to that illustrated in FIG. 4 and described above. In this embodiment, however, the single lubricant pump 70*d* is positioned within the cowling 25*d* of the outboard motor 20*d*. In this arrangement, lubricant is drawn from the tank 78*d* in the watercraft 22*d* by the pump 70*d* positioned at the motor 20*d* through an oil filter 68*d* and delivered through a check valve 74*d* to the vapor separator 46*d*.

This embodiment system has the advantage that the oil tank 58*d* is positioned solely in the watercraft 22*d*. In addition, the use of the check valve 74*d* provides the advantages described above.

Figure 6:
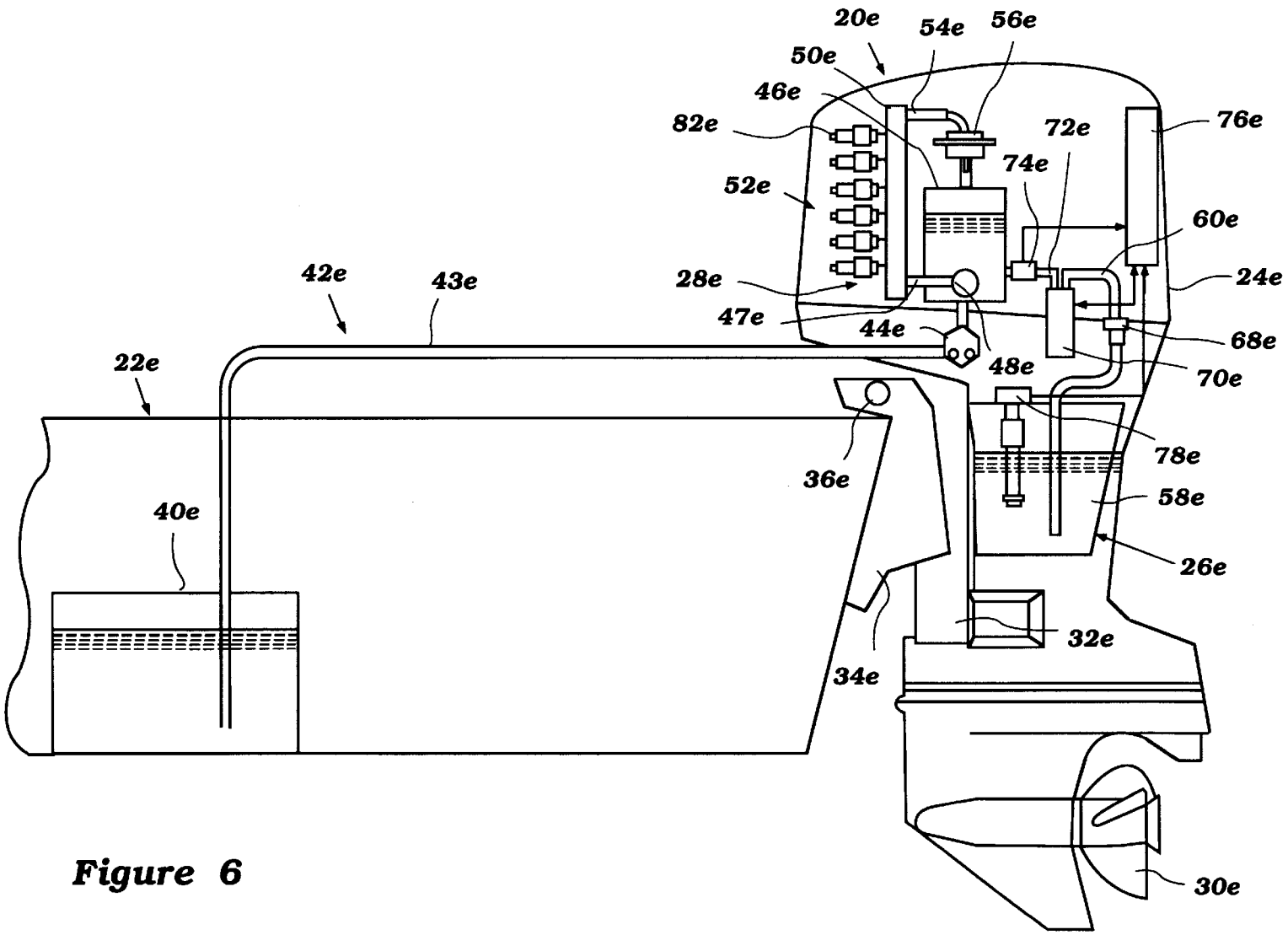
FIG. 6 is a side view of an outboard motor connected to a watercraft, the motor and watercraft illustrated in partial cross-section exposing an oil and fuel delivery system for an engine thereof in accordance with a sixth embodiment of the present invention.

A fuel and lubricant supply system in accordance with a sixth embodiment of the present invention is illustrated in FIG. 6. In the description and illustration of this embodiment, like parts have been given like reference numerals to those utilized to describe and illustrate the above embodiments, except that an "e" designator has been added thereto.

This embodiment system is similar to that illustrated in FIG. 5 and described above. In this embodiment, however, a single lubricant tank 58*e* is positioned at the motor 20*e*, and preferably within the cowling 25*e*. A single lubricant pump 70*e* also positioned within the cowling 25*e* of the outboard motor 20*e* is used to draw lubricant from the tank 58*e* for delivery through a valve 74*e* to the vapor separator 46*e*.

This embodiment system has the advantage that no oil tank need be provided in the watercraft 22*e*, leaving more space within the craft 22*e*. In addition, the use of the check valve 74*e* has the advantage described above.

Figure 7:
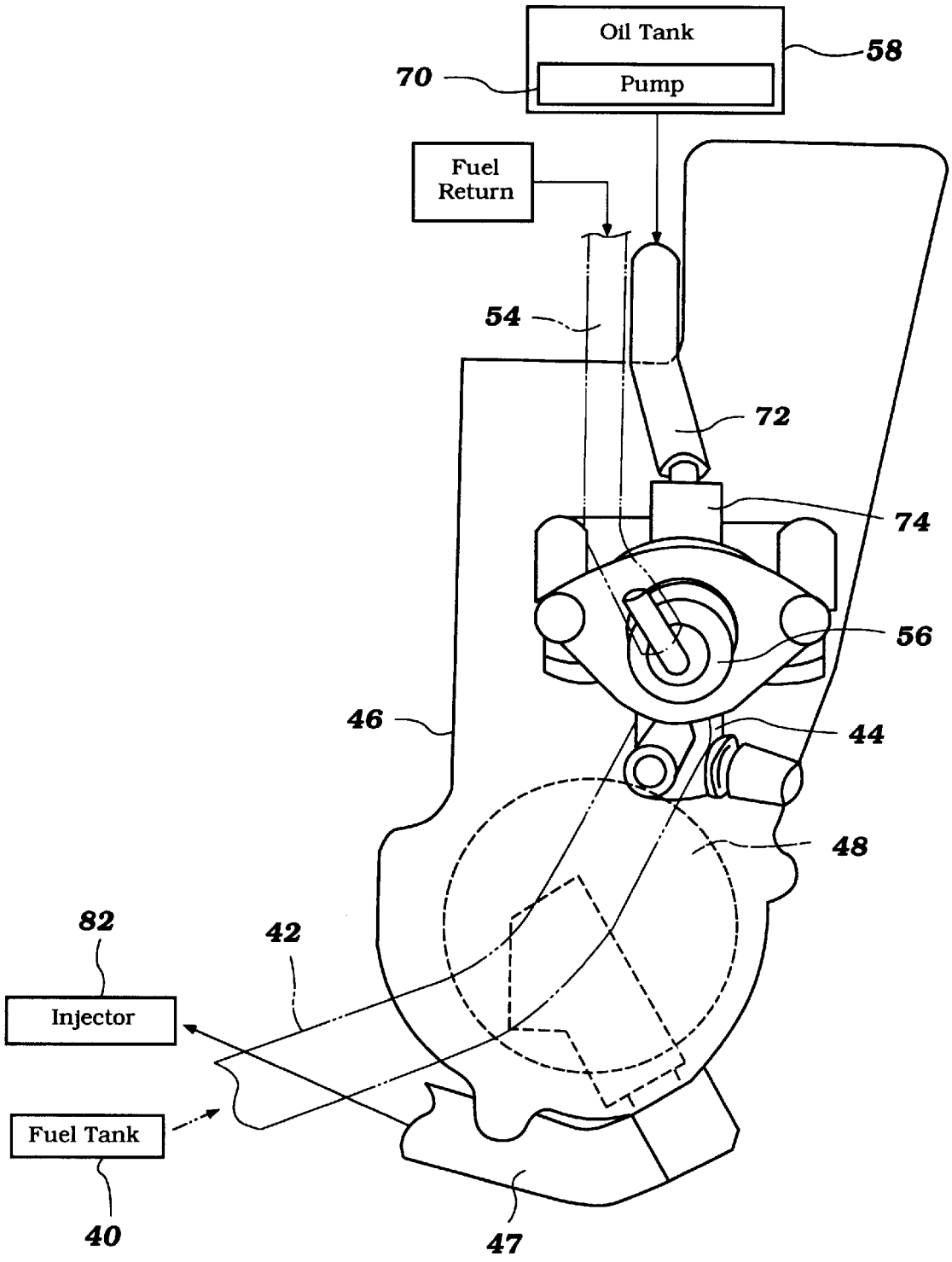
FIG. 7 is a top plan view of a vapor separator of the type used with an oil and fuel delivery system as illustrated in FIGS. 1–6.

FIG. 7 illustrates in greater detail the vapor separator 46 utilized in conjunction with the embodiment systems illustrated in FIGS. 1 and 4–6. The separator 46 is similar to that illustrated in FIGS. 2 and 3, except in the embodiments illustrated therein the valve 74*b*,74*c* is positioned remote from the separator. As illustrated, the valve 74 may be provided as part of, or even positioned within, the separator 46.

Figure 8:
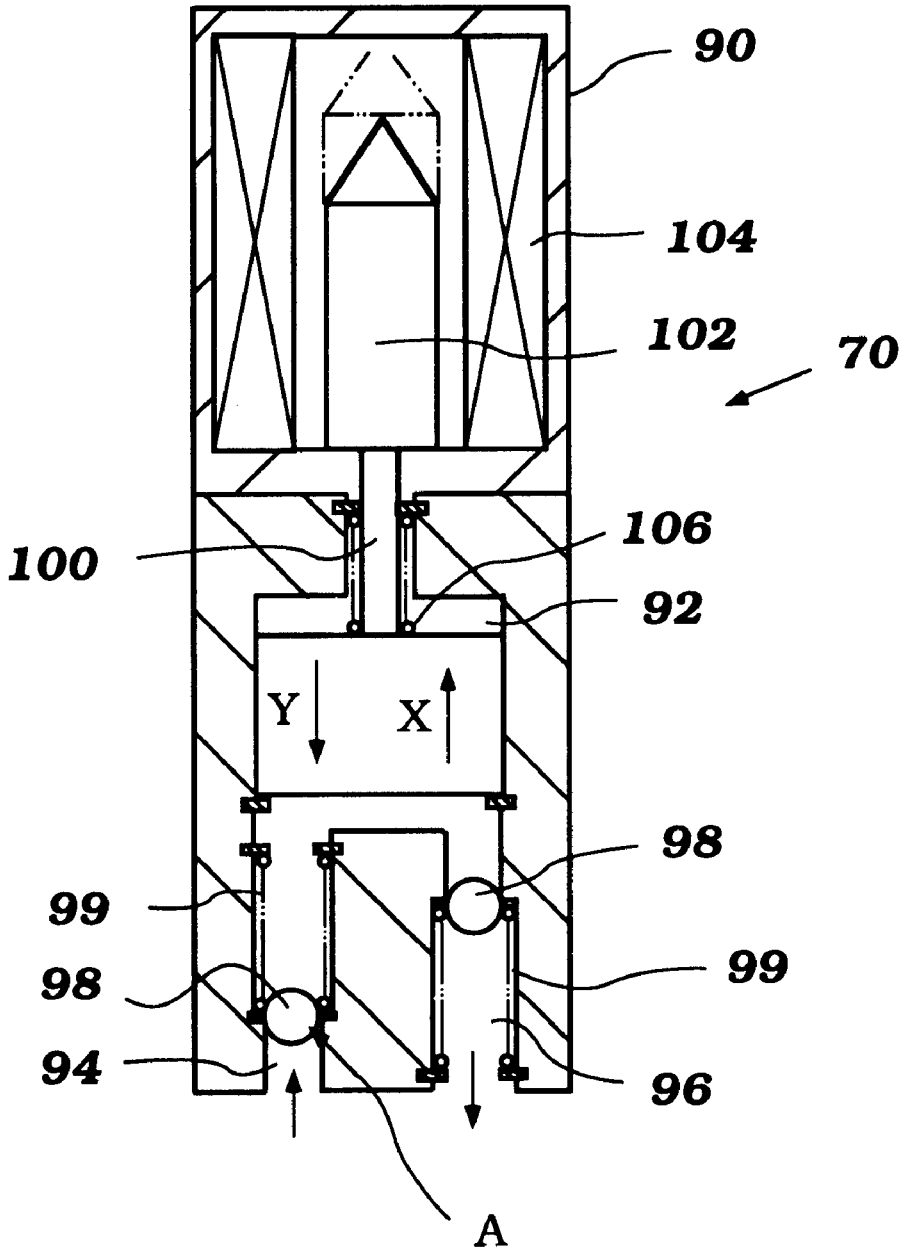
FIG. 8 is a cross-sectional view of an oil pump for use with the systems illustrated in FIGS. 1–6.

FIG. 8 illustrates the lubricant pump 70 used to pump the lubricant as illustrated in FIG. 1 (see also FIGS. 2–6, wherein the pump is labeled 70*a*–70*e*, respectively). This pump 70 is preferably of the electrically operated variety, having a body 90. A piston 92 is movably positioned within a chamber of the body 90. An inlet port 94 leads to the chamber. An oil supply line leads to the inlet port 94 (for example, in FIG. 6, line 60*e* leads to the pump 70). Similarly, an outlet port 96 leads from the chamber. The delivery line 72 is connected to the outlet port 96 and extends to the vapor separator 46 as described in more detail above. A ball-type check valve comprising a ball 98 which is biased by a spring 99 is provided in the both the inlet and outlet ports 94,96 for controlling the flow of oil in and out of the pump 70, as described in more detail below.

A stem 100 portion of the piston 92 extends in the opposite direction of the chamber through a guide, where it is connected to a plunger 102. The plunger 102 is preferably at least partly metallic and is positioned within a coil 104, thereby forming a solenoid where an electric charge applied to the coil 104 causes movement of the piston 92 in only one direction. A return spring 106 is provided about the stem 100 of the piston 92 for moving the piston in the opposite direction.

Operation of the pump 70 is as follows. When the piston 92 is retracted, the solenoid is activated and the plunger 102 moves downwardly, thus forcing the piston 92 downwardly. As the pressure of the oil within the chamber increases, the check valve 98 in the outlet port 96 moves the ball 98 into a position in which the spring 99 is compressed and in which the ball 98 is in a position which allows oil to pass therethrough. Notably, the spring 99 has the effect of biasing the ball 98 within the inlet port 94 into a position in which the ball 98 blocks the inlet port and prevents flow therethrough..

After the oil has been expelled and the solenoid de-activated, the return spring 106 causes the piston 92 to move back upwardly to its original position. As the pressure within the chamber lowers during this movement, oil is drawn through the check valve in the inlet port 94 into the chamber from the supply line as the ball 98 is drawn upwardly against the spring 99. At the same time, the spring 99 corresponding to the check valve in the outlet port 96 moves the ball 98 into a position which closes the outlet port 96, preventing oil which has been delivered to the output pipe from being drawn backwardly into the pump 70.

Figure 9:
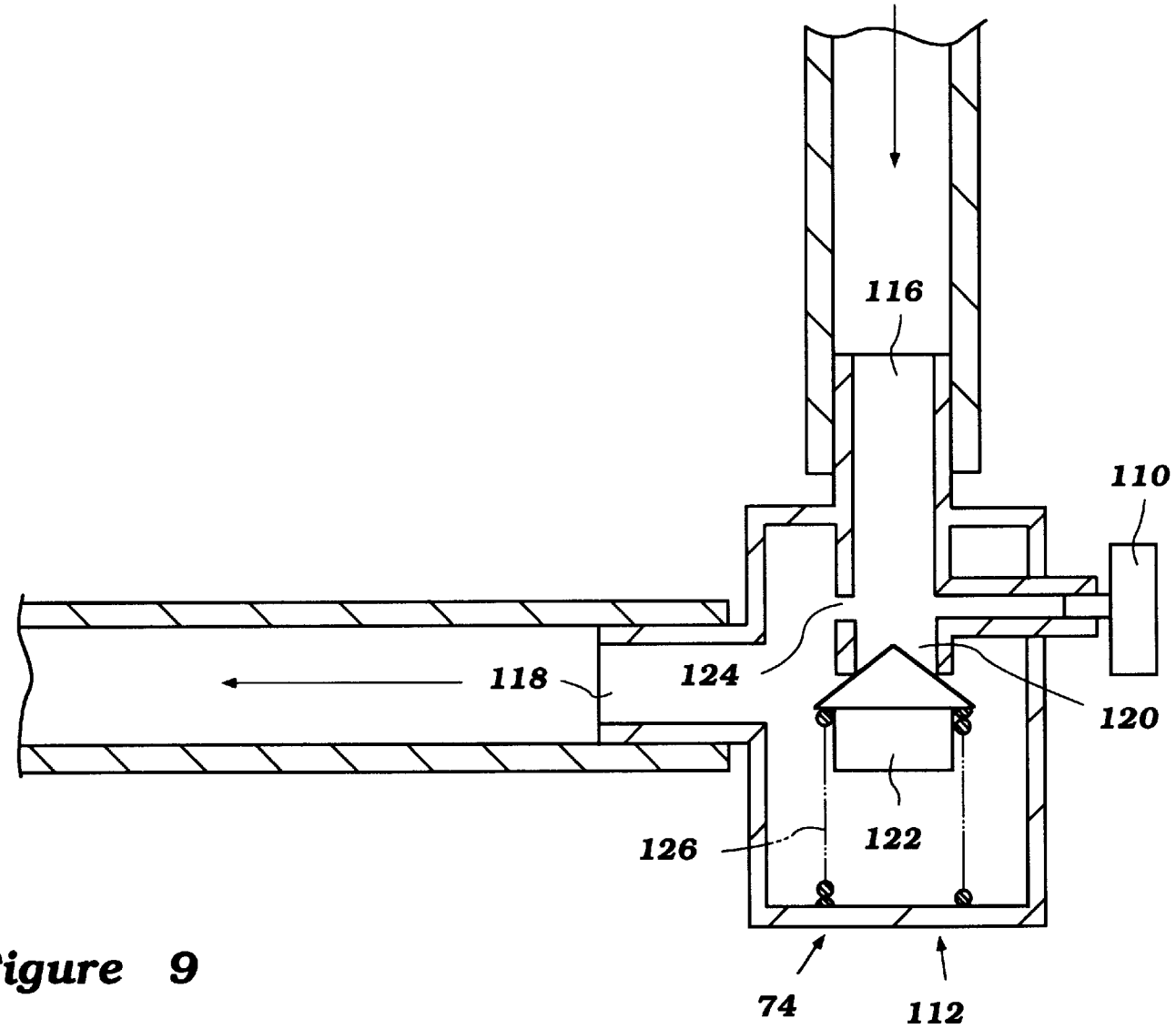
FIG. 9 is a cross-sectional view of a first embodiment control valve for use with the systems illustrated in FIGS. 1–6.
Figure 10A:
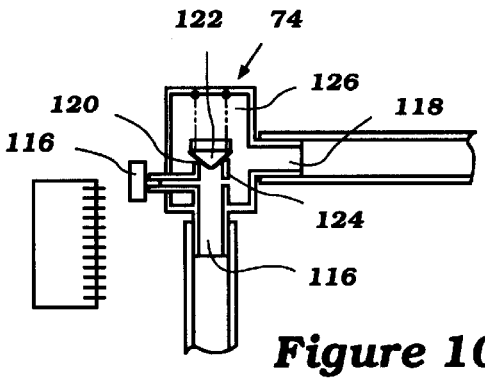
FIGS. 10(*a*)–(*g*) illustrated the operation of the control valve illustrated in FIG. 9 when used in conjunction with a system as illustrated in FIGS. 1–6 when only oil is flowing therethrough.
Figure 10B:
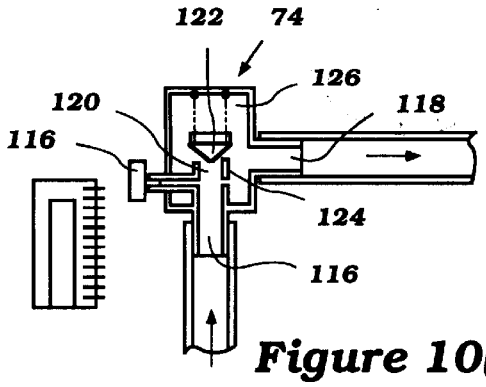
Figure 10C:
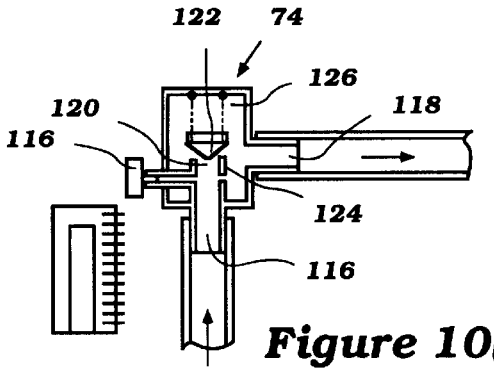
Figure 10D:
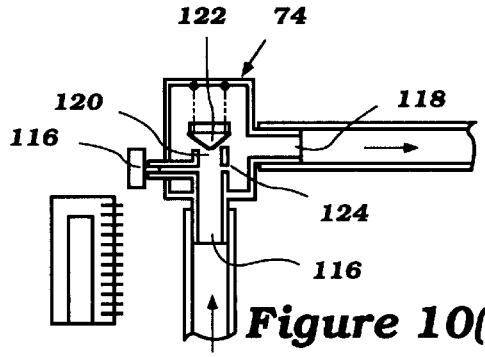
Figure 10E:
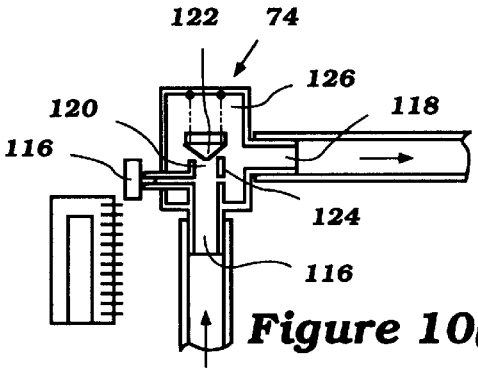
Figure 10F:
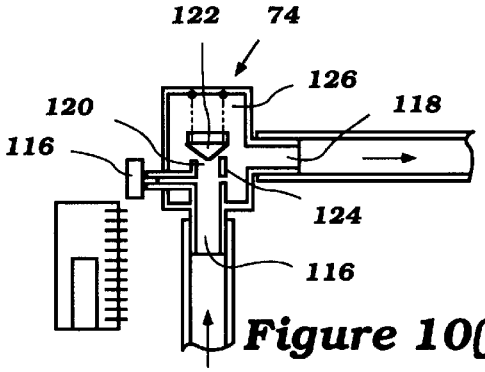
Figure 10G:
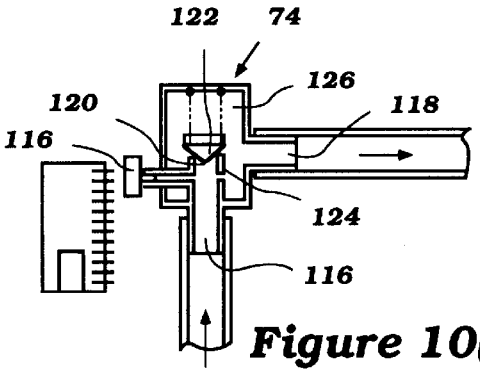

FIG. 9 illustrates a first embodiment check valve 74 in accordance with the present invention. As illustrated and described above, the valve 74 is preferably arranged to be fluid pressure operated, and to prevent the flow of lubricant and/or fuel back through the lubricant system. In addition, the valve 74 preferably includes a flow sensor 110 for providing fluid flow data to the ECU.

The valve 74 has a body 112 having an interior chamber. An inlet 116 leads into the chamber and an outlet 118 leads therefrom. In the embodiment illustrated in FIG. 1, the delivery line 72 leads to the inlet 116 and the outlet 118 leads to the vapor separator 46.

A passage leads from the inlet 116 to a check element seat 120 positioned in the chamber. A check element 122 is movably positioned in the chamber and adapted to seat against the seat 120 and seal the passage leading from the inlet 116. Preferably, a small by-pass or bleed passage 124 is provided through the seat from the main passage leading from the inlet 116.

The check element 122 is biased by a spring 126 into a position in which the check element 122 seats in the seat 120 and obstructs the passage leading from the inlet 116.

The sensor 110 is preferably a fluid pressure-detecting sensor, and is in communication with the passage leading from the intake 116 by a side-passage extending between the inlet 116 and the check element 122.

In operation, when the pressure at the inlet 116 side of the valve 74 becomes high enough, the check element 122 is moved away from the seat 120 against the spring force. At this time, lubricant flows through the valve 74 in the direction of the outlet 118.

When the pressure decreases, such as occurs when the ECU shuts off the oil pump 70 having sensed that sufficient oil has been delivered, the check element 122 reseats and closes the valve, preventing the flow of oil back through the valve from the outlet 118 to the inlet 116.

The operation of the valve 74 when primarily only lubricant is supply thereto is generally illustrated in FIGS. (*a*)–(*g*). FIG. 10(*a*) illustrates the valve when no fluid is passing therethrough and the check element 122 is seated. FIGS. 10(*b*)–(*g*) illustrate the valve 74 in various positions while the lubricant pressure is sufficient to open the valve 74 and fluid flows therethrough.

Figures 11A, 11B, 11C, 11D, 11E, 11F, 11G, 11H, 11I:
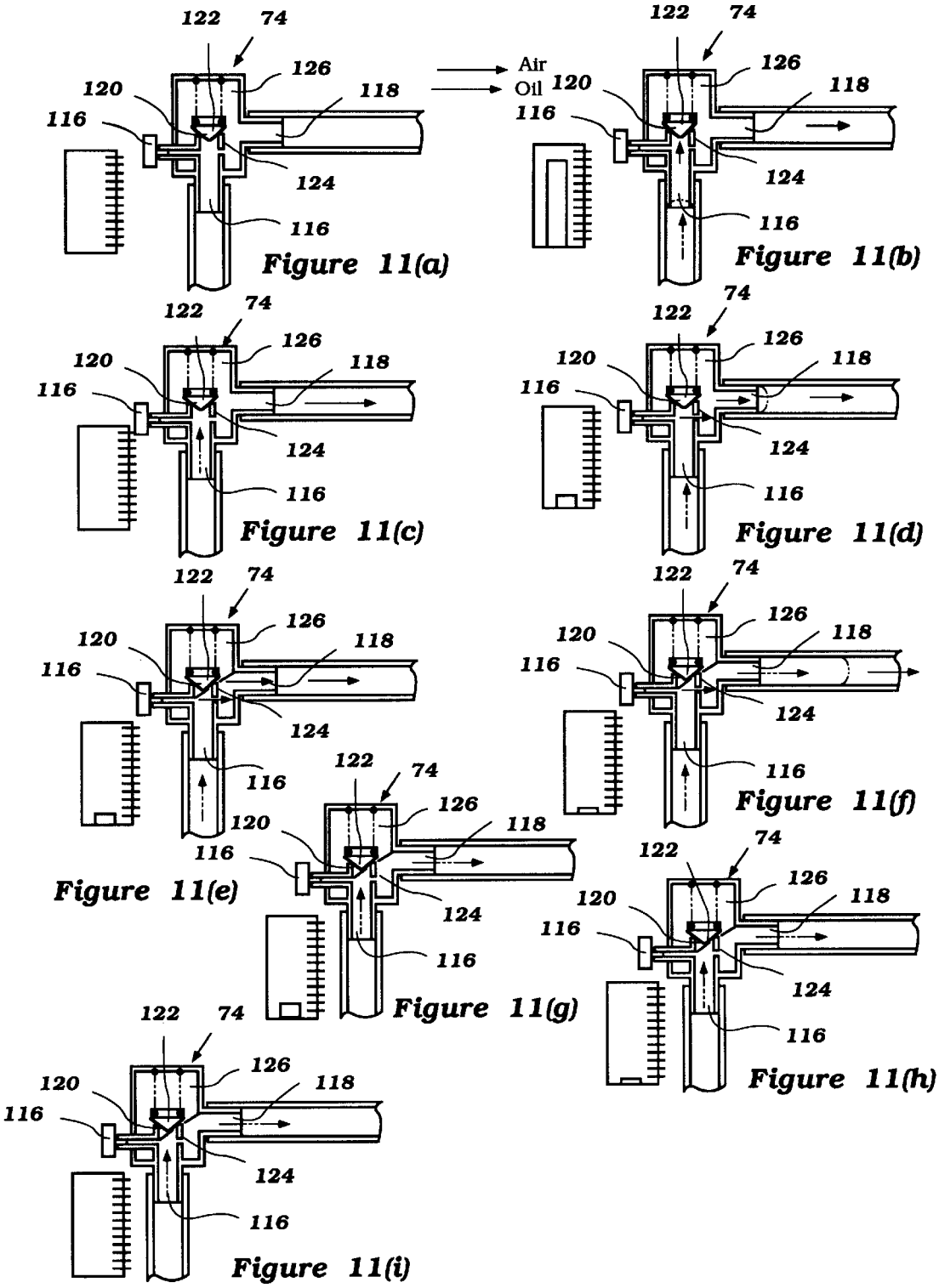
FIGS. 11(*a*)–(*i*) illustrate the operation of the valve illustrated in FIG. 9 when air is present in the lubricant.

Advantageously, the valve 74 is adapted to operate even when air is introduced into the lubricant system. As illustrated in FIGS. 11(*a*)14 (*i*), the valve 74 is arranged to effectively bleed off any air and provides a low pressure indication to the ECU or other controller, indicating to the operator that lubricating oil is not flowing through the lubricant system. As illustrated, when air is drawn through the lubricant system to the inlet 116 of the valve 74, the air passes into the valve and then through the bleed or by-pass passage 124 and thereon through the outlet 118 of the valve 74. In this manner, the air may be effectively transmitted to the vapor separator (46 in FIG. 1) for removal from the system.

In addition, since the bleed passage diverts the air and allows it to pass through the valve 74, the presence of the air in the system does not contribute to the pressure reading by the sensor 110. If only air is present in the system, as when the lubricant supply is exhausted, the sensor 110 indicates low or no fluid pressure in the valve 74. This sensor signal may be used by the ECU 76 to stop the engine, light a warning light or the like informing the user of the craft 20 the lubricant tank is empty or other problems with the lubricant system exist.

Figure 12:
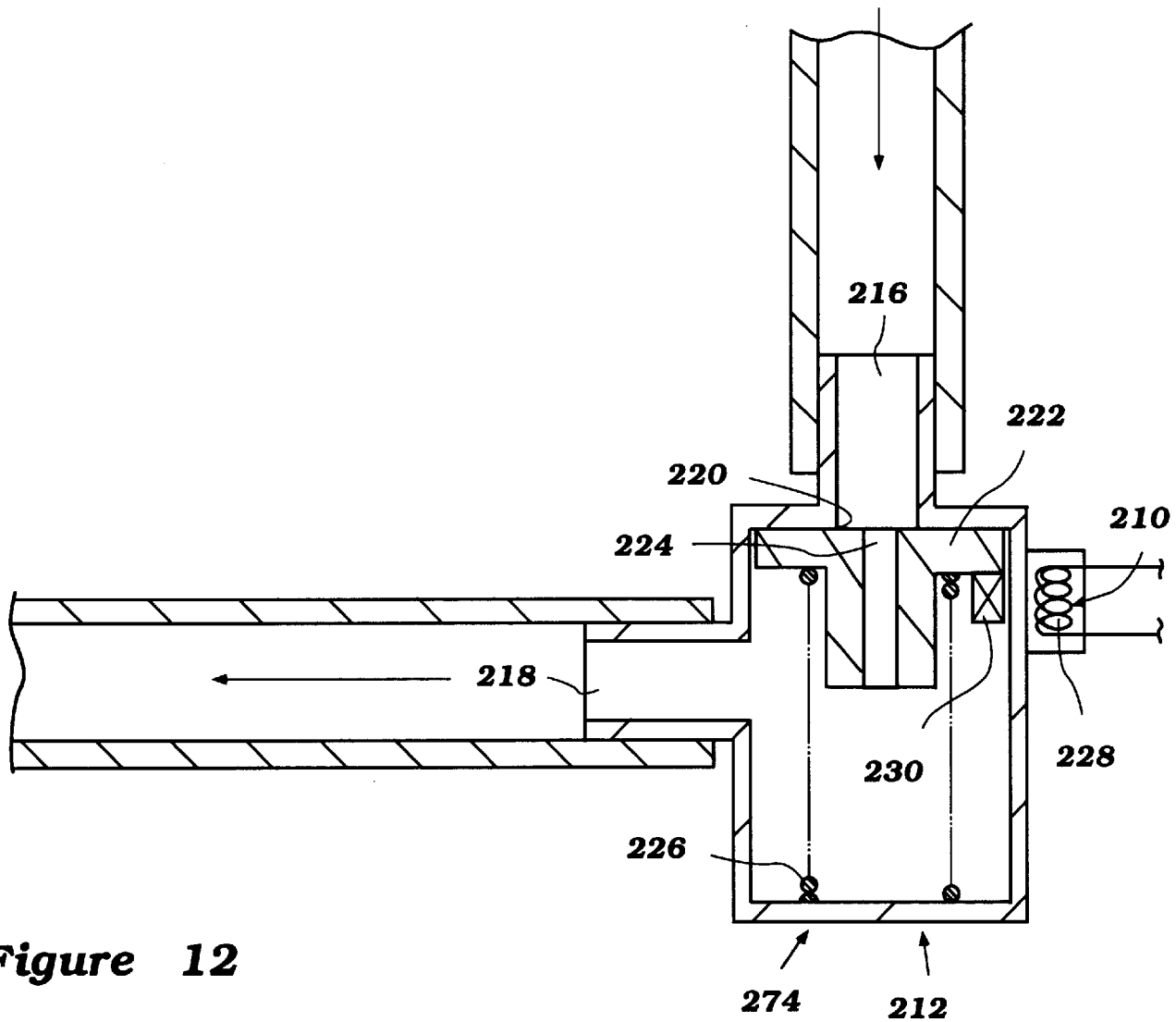
FIG. 12 is a cross-sectional view of a second embodiment control valve for use with the systems illustrated in FIGS. 1–6.
Figure 13A:
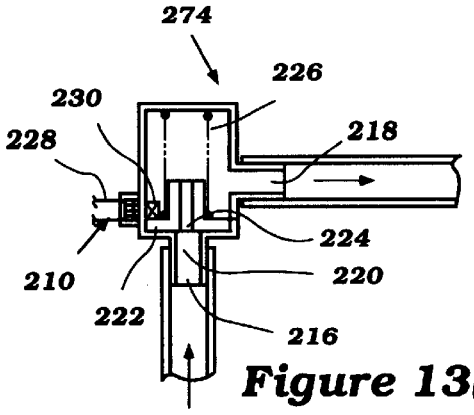
FIGS. 13(*a*)–(*g*) illustrate the operation of the control valve illustrated in FIG. 12 when used in conjunction with a system as illustrated in FIGS 1–6 when only oil is flowing therethrough.
Figure 13B:
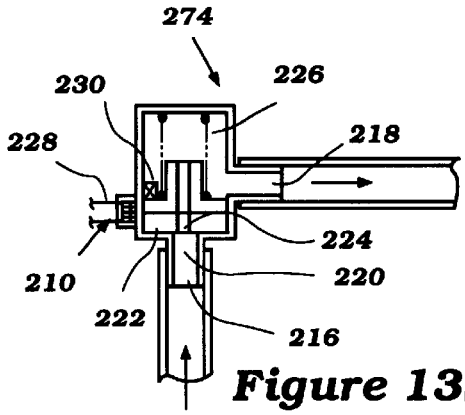
Figure 13C:
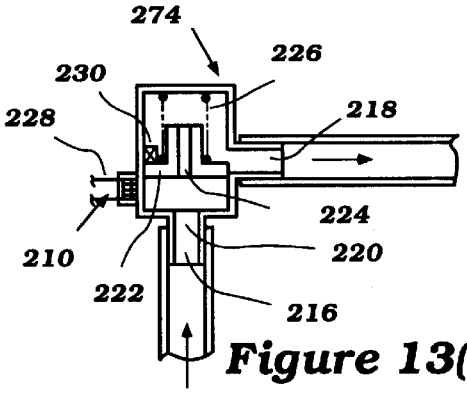
Figure 13D:
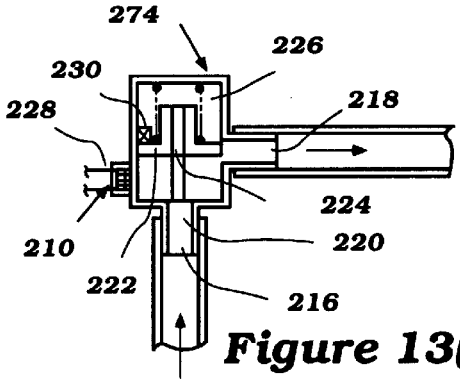
Figure 13E:
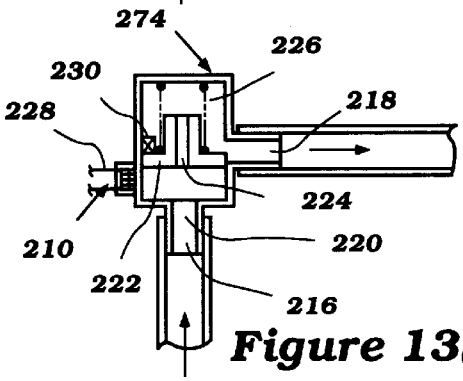
Figure 13F:
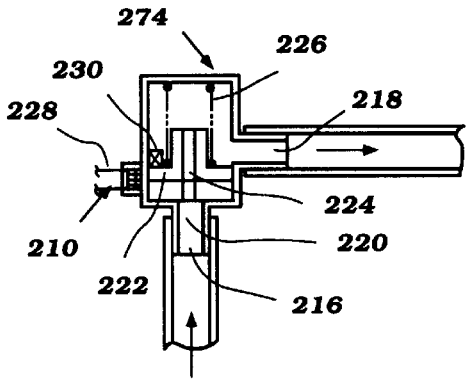
Figure 13G:
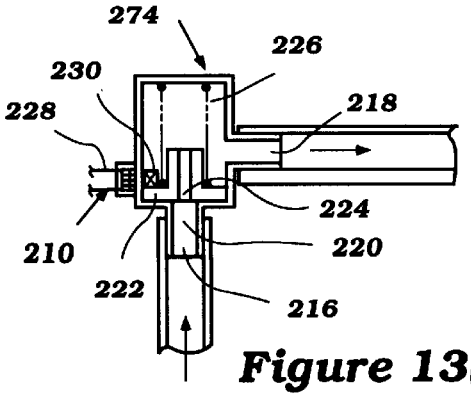

FIG. 12 illustrates an alternate embodiment check valve 274 to that illustrated in FIG. 9, which valve 274 may be used in the embodiment systems illustrated in FIGS. 16 above. This valve 274, like the last, is fluid pressure operated and includes a sensor for providing fluid pressure data. The valve 274 has a body 212 defining an interior chamber in which is movably positioned a valve element 222. An inlet 216 leads into the chamber, and an outlet 218 leads from the chamber.

The valve element 222 is movable between a first position in which the valve element rests against a valve seat 220, and a second position in which the valve element 222 is raised off of the seat 220, thus permitting fluid flow from the inlet to the outlet. Preferably, a spring 226 biases the valve element 222 towards the valve seat 220.

The valve element 222 preferably comprises a generally cylindrical member having a passage 224 therethrough allowing some fluid flow from the inlet 216 to the outlet 218 even when the valve element 222 is seated against the valve seat 220.

Means are provided for sensing and outputting data regarding the fluid flowing through the valve 274. Preferably, this means comprises a fluid flow capacity-type sensing device 210. As illustrated, this device includes a coil 228 positioned near the valve element 222 (such as connected to the outside of the body 212 as illustrated) for cooperation with a magnetic element 230 connected to the valve element 222. As the element 222 moves, a change in electric potential is generated in cooperation with the coil 210. This signal is useful in determining the distance by which the element 222 has moved within the chamber away from the seat 220, and thus the degree to which the valve 274 is open. From this data, fluid flow rate and/or pressure may be determined.

FIGS. 13(*a*)–(*g*) illustrate a state of operation of the valve 274 illustrated in FIG. 12 where lubricant is supplied to the valve 274. FIG. 13(*a*) illustrates the valve element 222 as fluid pressure is applied thereto. As illustrated in FIGS. 13(*b*)–(*d*), upon application of increased fluid pressure, the valve element 222 moves upwardly within the chamber to a point where a fluid path is established from the inlet 216 to the outlet 218. As the fluid pressure decreases, the valve element 222 is biased closed against the seat 220, as illustrated in FIGS. 13(*e*)–(*g*).

As described above, as the valve element 222 moves, a signal corresponding to the fluid pressure within the valve 274 is generated by the sensor device 210. As illustrated in FIG. 1, this signal may be relayed to the ECU 76 for use in controlling various system functions.

Figures 14A, 14B, 14C, 14D, 14F, 14G, 14H, 14I:
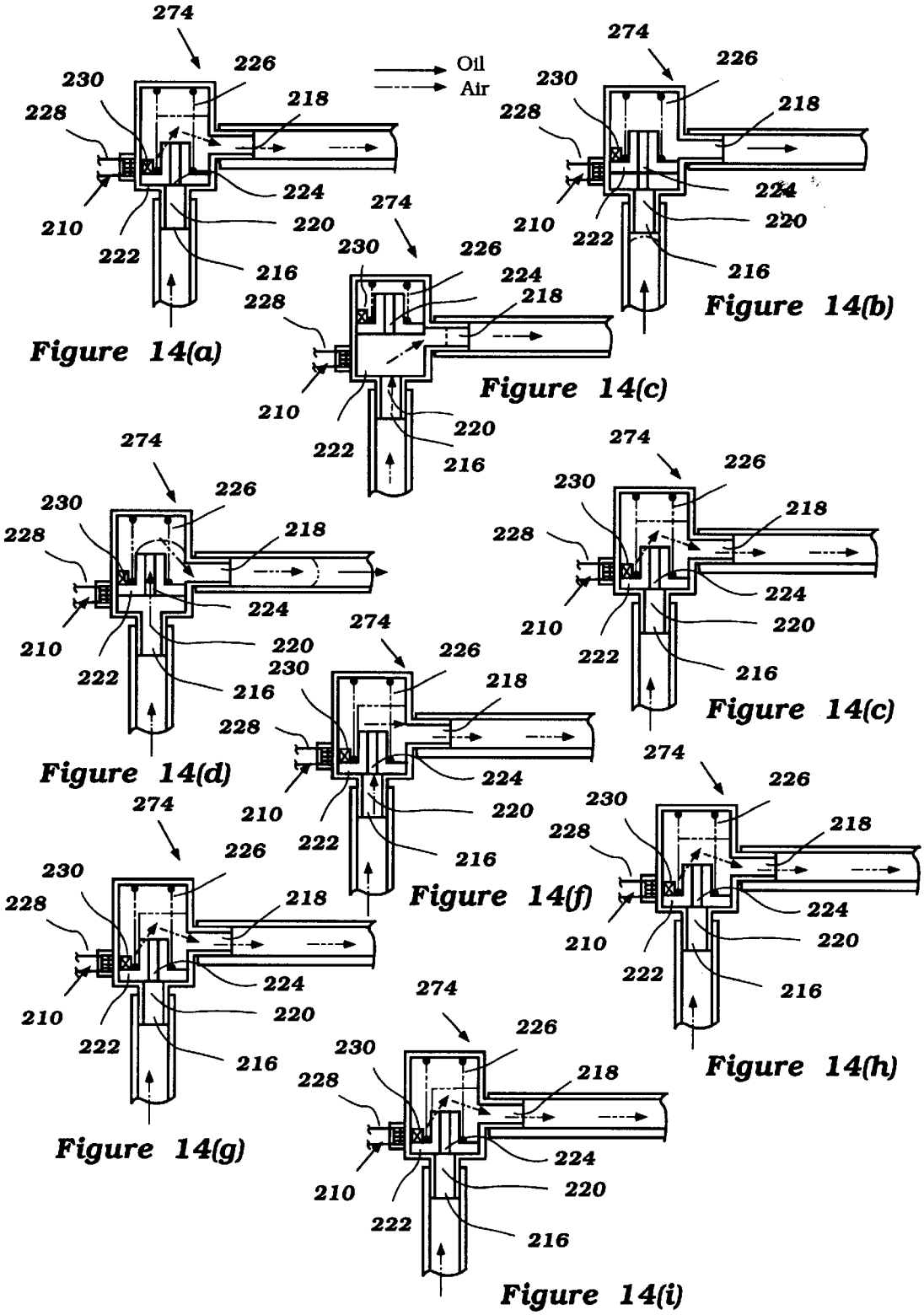
FIGS. 14(*a*)–(*i*) illustrate the operation of the valve illustrated in FIG. 12 when air is present in the lubricant.

FIGS. 14(*a*)–(*i*) illustrate the operation of the valve 274 illustrated in FIG. 12 when air is present in the lubricant supply system. As illustrated therein, when air is present in the system, it is effectively passed through the valve 274 from the inlet 216 to the outlet 218 even when the valve element 222 is not open. In particular, the by-pass or bleed passage 224 is adapted to pass air therethrough (and not significant amounts of fluid).

Advantageously, the air thus passes through the valve 274 without opening the valve element 222, and thus prevents the sensor 210 from giving a false indication of high lubricant flow when substantial air is present in the line.

As described above, when the valves 74,274 illustrated in FIGS. 9–14 are used in the systems illustrated in FIGS. 1–7, they are useful in preventing the reverse flow of fuel into the lubricant system. In addition, however, the valves 74,274 provide data regarding lubricant flow for use in controlling the lubricant delivery pump or similar means so that lubricant is accurately delivered to the fuel system.

Of course, the foregoing description is that of preferred embodiments of the invention, and various changes and modifications may be made without departing from the spirit and scope of the invention, as defined by the appended claims.

What is claimed is:

1. A fuel and lubricant supply system for an engine powering an outboard motor connected to a hull of a watercraft, the engine positioned within a cowling of the motor, said system including an oil supply, a fuel supply, a fuel supply mechanism including a fuel pump for supplying fuel from said fuel supply to the engine, an oil supply mechanism including an oil pump for supplying oil from said oil supply into fuel delivered by said fuel supply mechanism, said oil supply mechanism including a fluid pressure operated check valve independent of said oil pump and positioned at a location where oil is introduced into said fuel supply mechanism for permitting the flow of lubricant only in the direction into said fuel supply mechanism.

2. The fuel and lubricant supply system in accordance with claim 1, wherein said fuel supply comprises a reservoir positioned in said watercraft.

3. A fuel and lubricant supply system for an engine powering an outboard motor connected to a hull of a watercraft, the engine positioned within a cowling of the motor, said system including an oil supply a fuel supply, a fuel supply mechanism for supplying fuel from said fuel supply to the engine, an oil supply mechanism for supplying oil from said oil supply into fuel delivered by said fuel supply mechanism said oil supply mechanism including a fluid pressure operated check valve for permitting the flow of lubricant only in the direction of said fuel supply said check valve including means for detecting lubricant flowing therethrough and providing a signal in response thereto.

4. The fuel and lubricant supply system in accordance with claim 3, wherein said means detects the pressure of lubricant flowing through said valve.

5. The fuel and lubricant supply system in accordance with claim 3, wherein said means detects the rate of flow of lubricant flowing through said valve.

6. The fuel and lubricant supply system in accordance with claim 1, wherein said check valve comprises a body having a fluid path therethrough leading from an inlet to an outlet, and a valve element positioned in said body and movable between a first position in which said element closes said fluid path and a second position in which said fluid path is unobstructed upon application of fluid pressure above a predetermined amount at said inlet.

7. The fuel and lubricant supply system in accordance with claim 6 wherein a spring biases said element into said first position.

8. A fuel and lubricant supply system for an engine powering an outboard motor connected to a hull of a watercraft, the engine positioned within a cowling of the motor said system including an oil supply, a fuel supply, a fuel supply mechanism for supplying fuel from said fuel supply to the engine, an oil supply mechanism for supplying oil from said oil supply into fuel delivered by said fuel supply mechanism, said oil supply mechanism including a fluid pressure operated check valve for permitting the flow of lubricant only in the direction of said fuel supply, said check valve comprising a body having a fluid path therethrough leading from an inlet to an outlet, a valve element positioned in said body and movable between a first position in which said element closes said fluid path and a second position in which said fluid path is unobstructed upon application of fluid pressure above a predetermined amount at said inlet, and an air bleed passage leading through said valve from said inlet to said outlet which is unobstructed even when said valve element is in said first position.

9. The fuel and lubricant supply system in accordance with claim 6, wherein said valve element comprises a piston.

10. The fuel and lubricant supply system in accordance with claim 10, wherein said valve element comprises a piston and said bleed passage comprises a bore through said piston.

11. A fuel and lubricant supply system for an engine powering an outboard motor connected to a hull of a watercraft, the engine positioned within a cowling of the motor, said system including an oil supply a fuel supply a fuel supply mechanism for supplying fuel from said fuel supply to the engine, an oil supply mechanism for supplying oil from said oil supply into fuel delivered by said fuel supply mechanism, said oil supply mechanism including a fluid pressure operated check valve for permitting the flow of lubricant only in the direction of said fuel supply said fuel supply system includes a vapor separator and said check valve is positioned along said lubricant supply system adjacent said vapor separator.

12. A fuel and lubricant supply system for an engine powering an outboard motor connected to a hull of a watercraft, the engine positioned within a cowling of the motor, said system including an oil supply, a fuel supply, a fuel supply mechanism for supplying fuel from said fuel supply to the engine, an oil supply mechanism for supplying oil from said oil supply into fuel delivered by said fuel supply mechanism, said oil supply mechanism including a fluid pressure operated check valve for permitting the flow of lubricant only in the direction of said fuel supply, said oil supply mechanism comprises a pump, said system further includes a control unit, and said check valve includes means for sensing fluid flowing therethrough for providing data to said control unit for controlling said pump.

13. A fuel and lubricant supply system for supplying a mixture of lubricant and fuel to at least one charge former of an internal combustion engine positioned within a cowling of an outboard motor and powering a water propulsion device thereof, said supply system including a fuel supply, and means for delivering fuel through a fuel system to said at least one charge former, and a lubricant supply and means for delivering lubricant therefrom through a lubricant system to said fuel system, a fluid pressure operated check valve positioned along said lubricant system for permitting the flow of lubricant only in the direction of said fuel system, and means for sensing lubricant flowing through said check valve.

14. The fuel and lubricant supply system in accordance with claim 13, wherein said means comprises a pressure sensor.

15. The fuel and lubricant supply system in accordance with claim 13, wherein said means comprises a volumetric flow rate sensor.

16. The fuel and lubricant supply system in accordance with claim 13, including a control unit for controlling said means for delivering said lubricant, and wherein said means for sensing provides data to said control unit for controlling said means for delivering said lubricant.

* * * * *

UNITED STATES PATENT AND TRADEMARK OFFICE

CERTIFICATE OF CORRECTION

PATENT NO. : 5,941,745
DATED : August 24, 1999
INVENTOR(S) : Isao Kanno

It is certified that error appears in the above-identified patent and that said Letters Patent is hereby corrected as shown below:

Column 1,
Lines 22-35, replace with the following:

Several problems are encountered in providing lubricant to the fuel system including the fuel injectors. One problem arises in delivering the correct amount of lubricant. If insufficient lubricant is delivered, the lubricant is ineffective. On the other hand, delivering excessive amounts of lubricant may result in engine stalling, poor emissions, and even the fouling of catalytic converters.

Another problem is that while it is desired to deliver lubricant into the fuel system, the lubricant may be delivered to other parts of the engine as well, it therefore being undesirable for fuel to enter the lubricant system and contaminate the lubricant.

A lubricant and fuel supply system for an engine powering an outboard motor meeting the above-stated goals is desired.

SUMMARY OF THE INVENTION

In accordance with the present invention there is provided an improved lubricant and fuel supply system for an internal combustion engine. Preferably, the engine is of the type utilized to propel a water propulsion device of an outboard motor and is positioned in a cowling of the motor.

The system includes a fuel supply system for supplying fuel to at least one charge former of the engine from a fuel supply. Preferably, the fuel supply is a fuel tank positioned in a hull of the watercraft powered by the outboard motor. In addition, a lubricant or "oil" supply system provides oil into the fuel being supplied to the engine for mixing therewith, so that a mixture of oil and fuel is supplied to each charge former.

Column 2,
Line 25, please change "illustrated" to -- illustrate --.

Column 4,
Line 57, before "the ECU", insert -- to --.

Signed and Sealed this

Fifth Day of August, 2003

JAMES E. ROGAN
*Director of the United States Patent and Trademark Office*